United States Patent [19]

Pedersen

[11] 4,406,614

[45] Sep. 27, 1983

[54] BOILER LINER FOR OIL- OR GAS-FIRED BOILERS AS WELL AS PROCEDURE FOR THE MOUNTING OF SAME

[76] Inventor: Arne Pedersen, Enghavevej 10, Sorø, Denmark

[21] Appl. No.: 233,392

[22] Filed: Feb. 11, 1981

[51] Int. Cl.[3] ..... F23M 9/06

[52] U.S. Cl. ..... 431/171; 110/322

[58] Field of Search ..... 110/336, 323, 322; 431/171, 172, 116

[56] References Cited

U.S. PATENT DOCUMENTS

| | | | |
|---|---|---|---|
| 1,917,392 | 7/1933 | Pascoe | 431/171 |
| 2,197,619 | 4/1940 | Mueller | 110/322 X |
| 2,262,153 | 11/1941 | Wykes et al. | 431/171 |
| 2,392,587 | 1/1946 | Goerg | 110/322 |
| 2,791,190 | 5/1957 | Kolb et al. | 431/172 |
| 3,641,953 | 2/1972 | Herzberg | 110/323 |
| 3,832,815 | 9/1974 | Balaz et al. | 110/336 X |
| 4,222,338 | 9/1980 | Adams | 110/336 |

*Primary Examiner*—Edward G. Favors

*Attorney, Agent, or Firm*—Holman & Stern

[57] ABSTRACT

A boiler liner intended for improvement of combustion, reduction of smoke loss, and procurement of heat flow in existing oil- or gas-fired central heating boilers, through which the supplied heat energy is better utilized, by way of heat resistant material to upwardly confine the flame room as compared with an existing larger boiler chamber. The liner flame limitations are made from a highly insulating material which will cause the assimilated heat to be stored at temperatures almost equalling the flame temperature, resulting in the stored volume of heat being quickly given off by radiation after the flame has been extinguished. Undesirable heat convection in the boiler chamber will fail to manifest, and counterradiation from the highly insulated material will prolong the interval between the sparks.

6 Claims, 3 Drawing Figures

BOILER LINER FOR OIL- OR GAS-FIRED BOILERS AS WELL AS PROCEDURE FOR THE MOUNTING OF SAME

FIELD OF THE INVENTION

The invention relates to a boiler liner intended for improvement of combustion, reduction of smoke loss, and procurement of heat flow in existing oil- or gas-fired cental heating boilers, through which the supplied heat energy is better utilized by heat resistant material which upwardly confines the flame room as compared with an existing larger boiler chamber.

DESCRIPTION OF THE PRIOR ART

It is known from minor oil-fired boilers, with an oil consumption of about 2 kg/hour or below, to place a plate above the flame and thus detain the passage of the smoke gas up through the boiler chamber and out to the chimney flue whereby is achieved an improved heat utilization in the boiler.

Plates of said character are found in many different constructions, and the materials consist mainly of good heat conductors and/or heat absorbers. The plates allow a greater or smaller passage of the smoke gas through the slots established between boiler walls and plate edges.

Numerous different boiler constructions result in the plates being adapted to individual boilers with different sizes of slot openings, so that the smoke gas turbulence from the slot openings will assume a normal picture in the boiler chamber, and the exhaust smoke temperature will remain between 200 and 300 degrees C., producing a smoke loss of 10 to 15 percent. This can be described as an arbitrary and relatively great smoke loss. Even extremely modern firing plants—with or without these plates—will have a loss of supplied energy ranging about 10 percent.

BRIEF SUMMARY OF THE INVENTION

The object of the present invention is to provide a boiler liner that will ensure a cleaner combustion and regulate compulsorily the heat flow in the boiler chamber, whereby the heating surfaces of the boiler are continuously kept free of soot deposits, and by means of which the supplied heat energy is conveyed optimally to the boiler water, before an appropriate volume of hot smoke gasses are let out through the chimney.

This is according to the invention achieved in that the flame limitation is made of highly insulating material.

A boiler liner consisting of the described heat resistant and highly insulating material is built up in the boiler chamber at a suitable height over the flame. The liner can consist of a horizontal layer of plates, resting against the heating surfaces of the boiler chamber, and of vertical upright plates likewise resting against the heating surfaces. The plates are positioned at an exact distance from the heating surfaces in a manner as to form slot openings the width of which shall be less than half the depth of the slots whereby is achieved a linear smoke gas exhaustion from the slots along the heating surfaces situated perpendicularly to the slot openings without noticeable turbulence to heat the central section of the boiler chamber for no purpose.

In practice and by laboratory examinations made by Jydsk Teknologisk Institut (Jutland Institute of Technology) at Aarhus it has been established that the boiler liner will ensure temperatures quite close to the heating surfaces after the passage of the smoke gas through the slots, being about 300 degrees higher than the temperature in the interior of the remaining boiler chamber. In this manner the boiler liner will allow a complete control of the smoke loss, and make it possible—proportionally with the quality of the chimney—in each particular case to determine the minimum and/or absolute smoke loss for instance by extending the slot opening along the hind wall of the boiler chamber. By way of a boiler liner of the said description the result will be an extremely low smoke loss.

According to the invention the material, e.g. Vermiculite, is designed as a building set, easily adapted to all types of boiler chambers by suitable mounting devices. Vermiculite, produced by the Moler Works of Denmark, is a highly insulating material with low volumetric specific heat and is resistant to heat loads of about 1200 degrees C. A material of this character will in addition to improving combustion conditions and gas flow offer a hitherto unknown additional utilization of the supplied energy in thermostat-regulated boilers partly because the material is easily cut through, whereby a precise and ideal slot opening is attainable for the individual boiler, and partly because the reflection from the burner chamber narrowed by the material will produce, to a higher extent than by the use of already known fireproof bricks an ideal temperature around the flame of from 950 to 1000 degrees C.

This will ensure a clean combustion which again will reduce the pollution from the chimney smoke substantially, and produce a desirable temperature of about 400 to 500 degrees C. in the slot opening between heating surfaces and the plates, which in case of slightly sulphur containing oils will ensure improved conditions of formation of $SO_3$, sulphurous acid, in the contact with the heating surfaces of the boiler. The heating surfaces will thus be kept mainly free of soot deposits.

The temperature attained in the slots between the plates and the heating surfaces of the boiler is conditioned by the inlet temperature of the gasses passing through the slots, as well as by the fall of temperature appearing during the passage of the gasses through the slots. A relatively wide slot will thus produce excessive temperatures, whereas a relatively narrow slot will result in temperatures unnecessarily far below the conversion temperature for $SO_2$ to $SO_3$, and accordingly too slow a rate of formation of sulphurous acid.

It has been proved in practice that the boiler liner during 8 to 14 days after the installation will disintegrate old firm deposits and clean the heating surfaces completely.

The highly insulating effect of the materials will result in the assimilated heat being stored at temperatures near to the flame temperature, and cause the stored volume of heat to be quickly given off by radiation, as the surface of the Vermiculite plates will be cindered, and it will appear that the temperature will rise comparatively more due to the said radiation when the flame is extinguished. At the same time an undesirable heat convection will fail to manifest in the boiler chamber, which by known flame limitations is produced by the presence of good heat conductors and/or heat absorbing bricks. The returned radiation from the highly insulating material will prolong the interval between the sparks, which has been documented by laboratory research. The aggregate effect of the boiler liner will result in efficiency effect of the supplied energy of up to 96 percent. In this respect the boiler liner according to the invention differs completely from known flame temperature regulation methods and socalled "smoke turning plates," in which materials are applied that produce the said heat convection in the boiler chamber after the extinguishing of the fire.

The invention relates furthermore to mounting the boiler liner in all types and sizes of boilers.

There are mainly two existing categories of boilers, viz., cast iron boilers with heating surfaces in corrugated profile, and plate iron boilers with smooth surfaces. The boiler liner can be built up from the bottom of the boiler as a building set, as the longitudinal plates are adjusted to the depth of the boiler chamber, and the crosswise plates keep the longitudinal plates interlocked with the already mentioned precalculated precise slot opening at the heating surfaces. It is according to the invention advantageous that the material is suspended on metal angles, fastened to the rigging screws distended in the upper section of the boiler.

In boilers having heating surfaces with corrugated profile, the bottoms of the profile will form natural openings for the desired slot openings, when the plates are resting against the profile.

In boilers with smooth heating surfaces those plates resting against the heating surfaces are provided with 2 cm deep grooves, by which the ideal slot opening has been obtained.

BRIEF DESCRIPTION OF THE DRAWING

The invention will in the following be described in detail with reference to the drawing in which.

DETAILED DESCRIPTION

Figure 1:
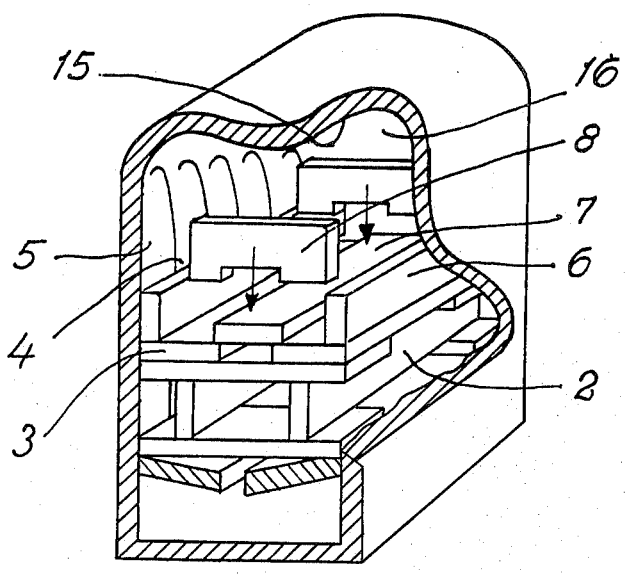
FIG. 1 is a perspective, partly cross-sectional view showing an oil-fired cast iron boiler with corrugated profiles and a boiler liner according to the invention.
Figure 2:
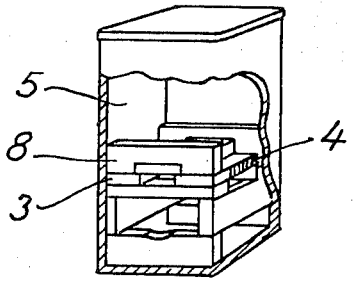
FIG. 2 is a perspective, partly cross-sectional view showing an oil-fired plate iron boiler with smooth heating surfaces and a boiler liner according to the invention.

FIGS. 1 and 2 show sections of oil-fired boilers, in the foremost wall of which the burner tube of the oil burner is situated. Above the burner tube and resting on a foundation of highly insulated plates 2 shaped according to the form of the boiler is placed a layer of plates 3, resting in boilers with corrugated profile against the heating surfaces 5 of the boiler, by which are produced slot openings 4 between the plate material and the indentations of the heating surfaces. Upright on this layer of plates 3 are placed two plates 6 in boilers with corrugated profile, whereby linear hot air flow along the heating surfaces is provided. The said plates 6 and loosely placed plates 7, covering the intervals between the plates, are kept in due position by the crosswise passing adaption plates 8. In boilers with smooth heating surfaces 5, cf. FIG. 2, the plates 3 of the layer which forms slot openings at the heating surface 5 are provided with 2 cm deep grooves. These grooves will provide the desired slot openings 4, when the plates 3 are pressed against the heating surfaces 5. The plates 3 are kept in due position by the crosswise passing adaption plates 8.

Figure 3:
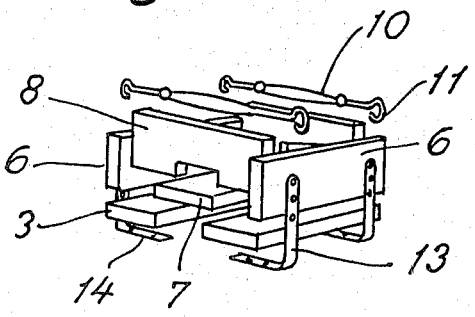
FIG. 3 is a perspective exploded view of a boiler liner seen from the front with separate individual parts.

In boilers with heating surfaces with corrugated profile the liner can, as shown in FIG. 3, is suspended by means of rigging screws 10, distended horizontally from side wall to side wall in the upper section of the boiler chamber. The rigging screws 10 are provided with open bends 11 of a special alloy of spring steel, and in the openings of which the angle bars 13 are suspended. The four angle irons 13 form the basis of the mounting of the boiler liner according to the same principles as specified with reference to FIG. 1. The horizontal bars of the angle irons 14 are coated with the same highly insulating material as that of which all the plates are made.

In the shown embodiment the combustion gasses from the flame will attain an extremely high temperature in the circumference of the flame due to the counterradiation of the plates whereby is secured a high quality of combustion.

The built up and narrowed burner chamber will contribute to maintaining greater initial air velocity in the chamber, whereby the convection of the area concerned is improved, after which the heat flow at a temperature of between 400 and 500 degrees C. will continue through the slots between the plates 3 and the heating surfaces 5. Due to the socalled Coanda effect along the heating surfaces 5, the heat flow will remain in immediate contact with the heating surfaces up to the ceiling 15 of the boiler, after which the heat flow severely drained of heat energy will escape out through the flues of the boiler into the chimney.

In case the chimney of the central heating plant does not allow for the obtained low temperature of smoke, and provided it is impossible to improve otherwise the chimney conditions, the plates 3 are dismantled and shortened, so as to form a free opening to the hind wall 16 of the boiler. The chimney temperature will thus be raised by about 10 degrees C. for each ½ cm cut off the plates.

I claim:

1. A boiler liner for vertically oriented oil or gas fired central heating boilers, comprising an assembly of plates of heat insulating material arranged in the combustion chamber of the boiler between the burner and the exhaust flue and at least part of the inner heat exchange surfaces of the walls of the boiler to provide flow channels between some of said plates and said inner heat exchange surfaces and confine and direct the flow of combustion gases through said channels, said assembly of plates comprising support means supported on the walls of the combustion chamber to support said assembly of plates above said burner, and flow channel forming plates supported on said support means in spaced relationship with respect to each other and in contacting engagement with said inner surfaces of said walls at spaced locations, said flow channels comprising the spaces between said locations, and transverse retaining plates extending between said flow channel forming plates to retain said flow channel forming plates in said contacting engagement.

2. The boiler liner as claimed in claim 1 wherein said flow channel forming plates comprise a pair of horizontally extending plates in spaced relationship with respect to each other to provide an opening substantially in the middle portion of said combustion chamber with respect to said walls and a pair of vertically extending plates supported by their lower edges on said pair of horizontal plates, a cover plate supported on said pair of horizontal plates to substantially close said opening, and said retaining plates comprise at least two plates in abutting relationship at their ends with the inner vertical surfaces of said pair of vertically extending plates and each having a notch in the lower edge thereof which snuggly engages said cover plate.

3. A boiler liner as claimed in claim 2 wherein said flow channels comprise aligned grooves on the surfaces of said pairs of flow channel forming plates adjacent said inner heat exchange surfaces of said walls between said spaced locations of contacting engagement with said inner surfaces.

4. A boiler liner as claimed in either claim 2 or claim 3 wherein said assembly of plates comprises a building set adapted to be removably inserted in an existing boiler chamber, and said support means comprises support brackets having vertical and horizontal legs, said horizontal legs supporting said pair of horizontal flow channel forming plates, adjustable screw hangers mountable on said walls in the upper section of said chamber and hooks on the ends of said hangers removably engaging said vertical legs.

5. A boiler liner as claimed in claim 2 wherein said plates are made of Vermiculite.

6. A boiler liner as claimed in claim 5 wherein said plates and flow channels have dimensions and are positioned so that the temperature in said channels is maintained between approximately 500° C. and 400° C. when the temperature around the burner flame is approximately 950° C. to 1000° C.

* * * * *